United States Patent [19]

Falbo et al.

[11] Patent Number: 5,009,548

[45] Date of Patent: Apr. 23, 1991

[54] APPARATUS FOR AND A METHOD OF FACILITATING THE EXCAVATING AND REFILLING OF A TRENCH

[76] Inventors: G. P. "Sonny" Falbo, Rte. 3, Box 525 C, San Antonio, Tex. 78218; Jesse W. Harris, 3006 Mayfair, San Antonio, Tex. 78217

[21] Appl. No.: 470,949

[22] Filed: Jan. 26, 1990

[51] Int. Cl.[5] ..... B65G 21/10

[52] U.S. Cl. ..... 405/179; 198/314; 198/316.1; 198/371; 37/142.5

[58] Field of Search ..... 405/154, 174, 179; 198/312, 314, 315, 316.1, 371; 37/107, 142.5, 145; 175/62, 161; 180/906; 280/43.1, 772, 638

[56] References Cited

U.S. PATENT DOCUMENTS

| | | | |
|---|---|---|---|
| 236,192 | 1/1881 | Stillman | 198/360 |
| 850,107 | 4/1907 | Wolever | 198/360 |
| 2,513,942 | 7/1950 | Johnson et al. | 180/906 X |
| 3,251,449 | 5/1966 | Hoppmann | 198/371 |
| 3,297,141 | 1/1967 | Janitsch et al. | 198/371 |
| 3,618,329 | 11/1971 | Hanson | 405/179 |
| 3,842,994 | 10/1974 | Theurer et al. | 414/339 |
| 4,689,903 | 9/1987 | Gilbert | 280/638 X |

*Primary Examiner*—Randolph A. Reese
*Assistant Examiner*—John Ricci
*Attorney, Agent, or Firm*—Gunn, Lee & Miller

[57] ABSTRACT

A method of excavating a trench (60) wherein lateral confinement such as walls, trenches, vehicular traffic, and the like prevent the accumulation of soil in the confined areas adjacent to the trench (60) and an apparatus for the same. The apparatus (10) consists of a double section belt conveyer, the two sections (12) and (14) connected at an articulable joint (34). The apparatus (10) is capable of selectively raising one end of a section above the other, with the conveyor being supported by axles (25) on which are mounted steerable-drive wheels (21). The method of removing the soil using the conveyor apparatus (10) consists of alternately removing the soil from the ground by loading it on one end of the apparatus, which carries it longitudinally either away from the work site or redeposits it in previously excavated trench as "backfill" (52), then using the conveyor apparatus (10) to bring in bedding (56) and other material (54), while the conveyor apparatus (10), straddling the ditch trench (60) is moved longitudinally as the trench (60) is excavated, pipe (58) laid, bedded, and backfilled to complete the process.

3 Claims, 7 Drawing Sheets

APPARATUS FOR AND A METHOD OF FACILITATING THE EXCAVATING AND REFILLING OF A TRENCH

FIELD OF THE INVENTION

The present invention relates to a method and apparatus for excavating trenches in laterally confined areas, and, more particularly, to a method and apparatus for using a conveyer which straddles the trench to alternately remove soil and add bedding and fill as the conveyor moves longitudinally.

BACKGROUND

The laying of sewage and water pipes commonly calls for the excavation of trenches. Traditionally, a trench is dug in twenty-foot (20') sections, that being the usual length of pipe sections, and the dirt is stacked on one or both sides of the trench as bedding is added and the pipe laid down. More bedding is added on top of the pipe, the removed soil is added as fill, packed down and the work is moved on to the following second twenty-foot (20'). Frequently, the excavation of such trenches occurs in laterally confined spaces, such as alleyways or medians in a road. Such lateral confinement creates a number of problems, one of which is where to put the excavated soil. There may be very little room on either side of the trench to lay the removed soil.

The problems created by stacking the removed soil in or near the trench site include damage to fencing and walls on private property as the dirt is dumped to either side of the trench. Moreover, the confined space makes it more dangerous for the workers to lay the pipe and grade the bedding, and to operate the backhoe and other machinery in and around the trench. As a result of such problems, trenching in confined areas is a slow, laborious, and expensive process, little improved in the last 30 years.

U.S. Pat. No. 3,842,994 (Theurer et al. 1974) discloses a train of freight cars with each car consisting of a storage bin with a top opening. An adjustable conveyer belt is located above each bin belt connecting it to the next bin. The belts are adjustable in height to carry rubble from an excavation site to the bin.

U.S. Pat. No. 850,107 (Wolever 1907) discloses a series of endless conveyer belt sections designed to convey articles from a sending station to a receiving station, wherein each section is attached to an adjacent section by using an adjustable swinging gate.

U.S. Pat. No. 236,192 (Stillman 1881) discloses an apparatus for conveying and distributing soil which consists of a series of endless belts arranged to receive material at one end to carry and deliver to the other end; the belts are connected to gates and pulleys to adjustably control the operation of the belts of a given section.

U.S. Pat. No. 4,256,213 (Shaw et al. 1981) discloses a flexible, mobile conveyer system comprised of a series of conveyer tracks connected at adjustable joints, which device is particularly useful in deep mining operations.

U.S. Pat. No. 2,479,823 (Ernst 1949) discloses a plural conveyer arrangement which includes a pivoting means for connecting two or more conveyers so that articles can be carried in angled directions should straight line conveyance not be feasible or desired. The conveyor units are not only pivoted together for angled-directional carriage of articles, but also expansible and contractible, making it possible to connect a loading platform with a specific station within a reasonable distance.

U.S. Pat. No. 3,251,449 (Hoppmann 1966) discloses a loading device which contains a reversible belt conveyer, which device can be raised and lowered with respect to a second conveyer.

However, none of the prior devices or methods address or solve the problems of working in a laterally confined space. These problems applicant solves by using an apparatus comprising a train of at least two endless, reversible conveyer sections linked by a pivoting means for connecting the sections so that soil can be carried an angled direction should straight line conveyance not be feasible. The pivoting means or swivel connection admits universal movement and allows for the removal of soil from a loading station to a receiving station and upon reversal of the belt conveyers and selectively changing the height of the belts, transporting bedding and fill from the receiving station to a filling station, including means for delivery to the area between the conveyer sections, from either end.

The present invention relates to means for and a method of excavating the spoil, laying bedding, "select material" and backfill, which apparatus method avoids the problems set forth above.

It is the purpose of the present invention to provide a means for facilitating the excavating and refilling of a trench, which means includes alternately removing spoil to create a trench, adding pipe, bedding, select material and backfill, repeated in sequence, using an apparatus which contains at least two longitudinal sections supported on trucks and linked at a universal pivot point, each section containing a reversible endless conveyer belt for alternately removing and adding material to and from the work site.

It is a further object of this invention to provide for an apparatus and method which includes a method for alternately removing and refilling dirt from a trench, which apparatus straddles the trench and consists of at least two conveyer belt sections, which apparatus carries material to and from the trench and moves longitudinally as the trench is excavated at one end and refilled at the other, which excavation and refill alternates with the laying of pipe sections.

It is a further object of the present invention to provide for an apparatus for aiding the excavation and filling of trenches in laterally confined areas, the apparatus comprising a first and a second conveyer section, each conveyer section having an endless belt, a belt drive means for energizing the conveyer belt, a means for connecting the two conveyer belt sections, which means can selectively position the adjacent conveyer means, one above the other, while at the same time allowing one section to pivot horizontally with respect to the other.

It is a further object of the present invention to provide for an apparatus which contains two units or sections, each having a conveyor belt, which sections meet at an attachment point, which point allows material carried on the conveyor belt of either section to be deposited at the junction of the two sections.

It is a further object of the present invention to provide for a two-section conveyor apparatus wherein each unit contains an endless, reversible conveyor belt and which units are attached such that adjacent ends may be raised, one above the other, for selectively carrying material from one end of the apparatus to the other, or depositing such material at the joint where the two sections meet.

Further objects of this invention will be apparent upon references to the following claims and specifications.

DESCRIPTION OF PREFERRED EMBODIMENT

Figure 1:
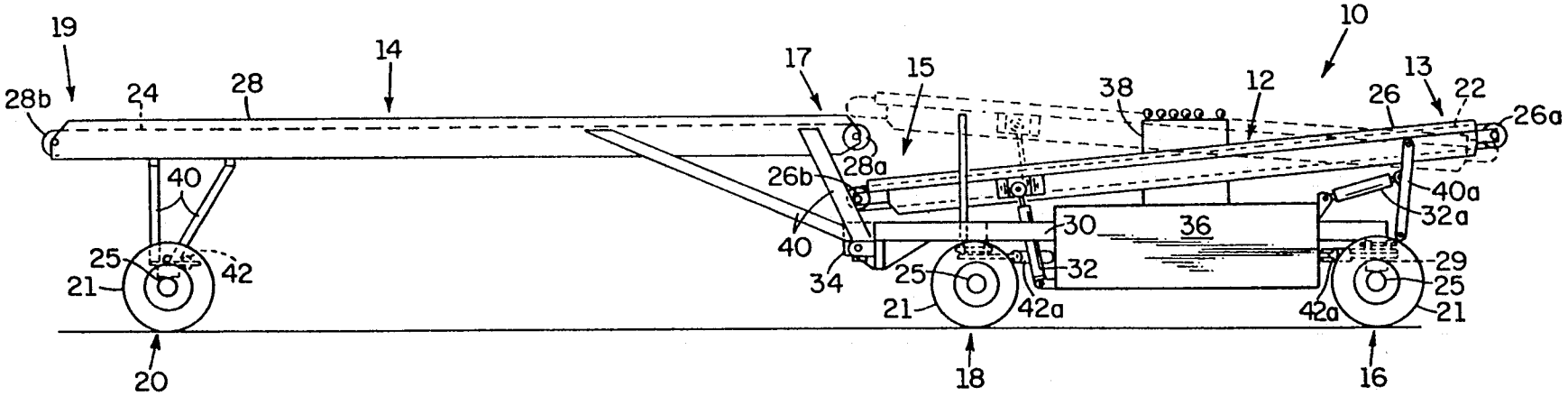
FIG. 1 is an elevational view of apparatus (10) showing first and second sections thereof.
Figure 2:
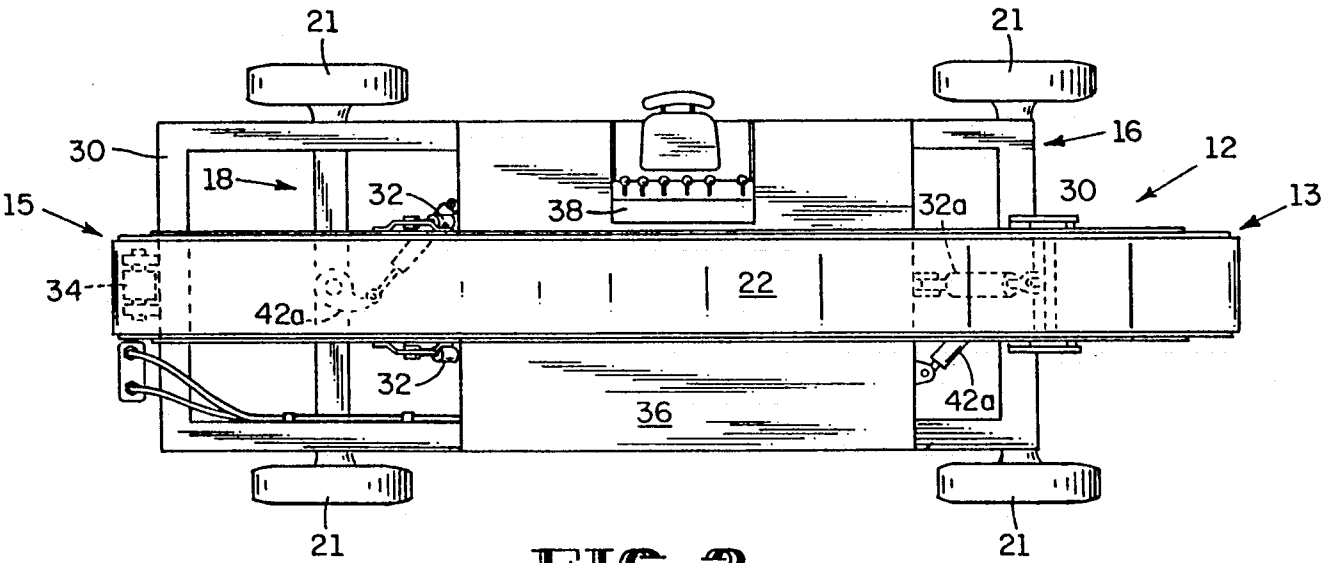
FIG. 2 is a top plan view of the apparatus showing the first or drive section thereof.
Figure 1A:
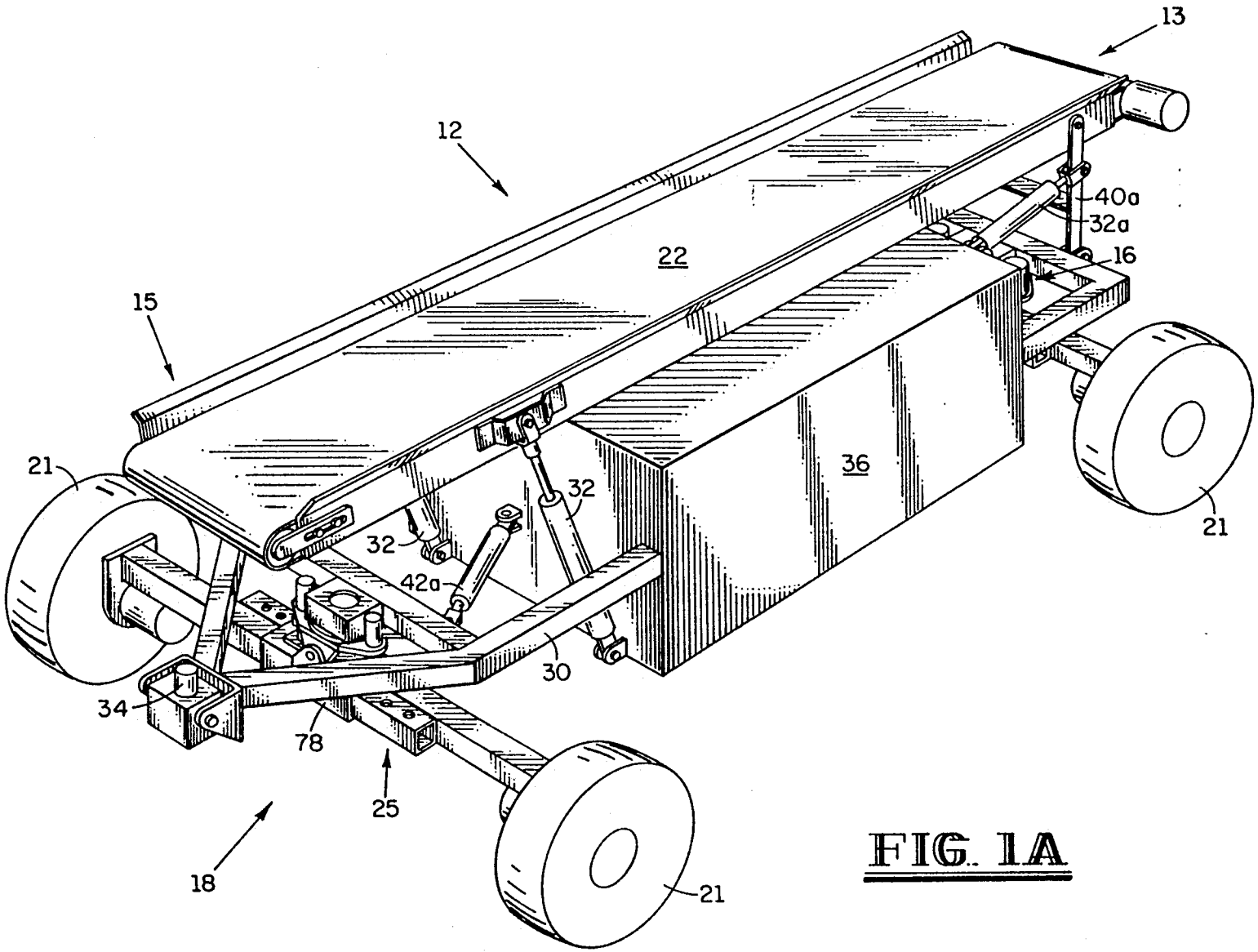
FIG. 1*a* is a perspective view of the apparatus as shown in FIG. 1.

FIGS. 1 and 1*a* disclose the apparatus of the present invention. Apparatus (10) is shown to have a first section (14) and a second section (12), the two sections being aligned along their longitudinal axes in such a manner as to straddle the trench (FIG. 1*a*). As can be seen from FIGS. 1 and 1*a*, Apparatus (10) is supported by drive truck (16), joint truck (18), and end truck (20). Trucks have wheels (21) and axles (25) which support first section (14) and second section (12). The trucks are located generally under second end (13) of second section (12), at first end (15) of second section (12), and at first end (19) of first section (14).

The first and second sections both contain an endless conveyer belt, first belt (24) and second belt (22), respectively. The endless conveyer belts extend between the two ends of each of the sections. The belts are reversible and carry dirt, spoil, fill, or other material to or from the trench. The belts and the pulley ends of each of sections (14) and (12) are supported by first belt frame (28) and second belt frame (26). The belt frames consist of laterally disposed, parallel, cross-braced, longitudinal members, which are connected at each end by pulleys (26*a*) and (26*b*) and (28*a*) and (28*b*). The belt frames are approximately 48 inches wide and 22 feet long and comprised of structural steel.

Second belt frame (26) is supported by vertically disposed support members (40*a*) attached at their lower ends to subframe (30). Support members (40*a*) are pivotally attached to subframe (30) and to second belt frame (26) in order to allow first end (15) to be selectively raised and lowered with respect to second end (17). Hydraulic means (32) and (32*a*) are pivotally connected to second belt frame (26) and to subframe (30), and driven by an hydraulic motor located in bay (36) through control means (38) to raise and lower first end (15). First end (15) must shift fore and aft so as to clear second end (17). This shift is accomplished using hydraulic means (32*a*). Along with the capability of raising and lowering first end (15), apparatus (10) has joint (34) which allows pivoting of one section with respect to the other, such that the first and second sections may be aligned with their longitudinal axes coincident with one another or in nonparallel relation. Articulation joint (34), allows first section (14) and second section (12), to be aligned in nonparallel relation. This must be accomplished as trucks (16), (18), and (20) contain steering means (42) which allow operator to independently control their direction.

Figure 2A:
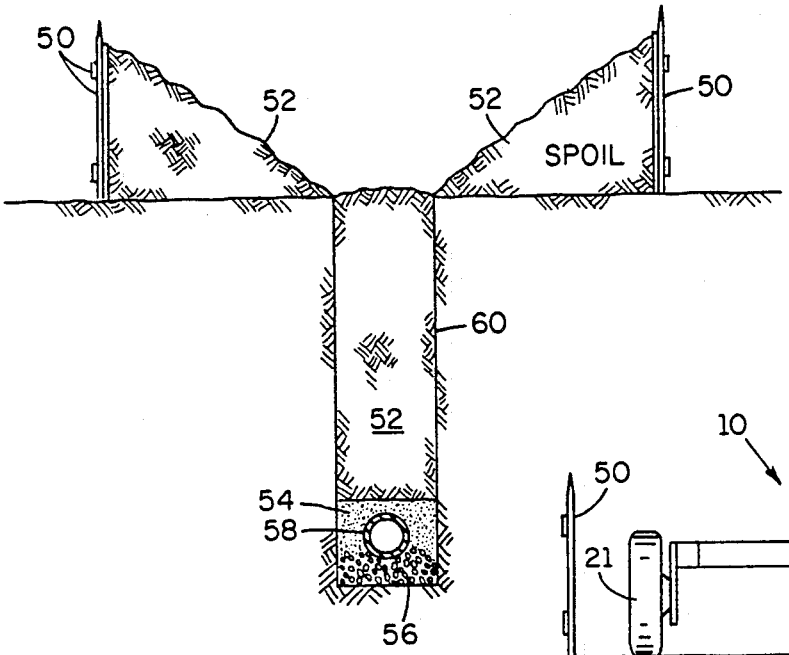
FIG. 2A (PRIOR ART)
FIGS. 2*a* and 2*b* illustrate the prior art method of removing spoil from trenches and backfilling the same.
Figure 3:
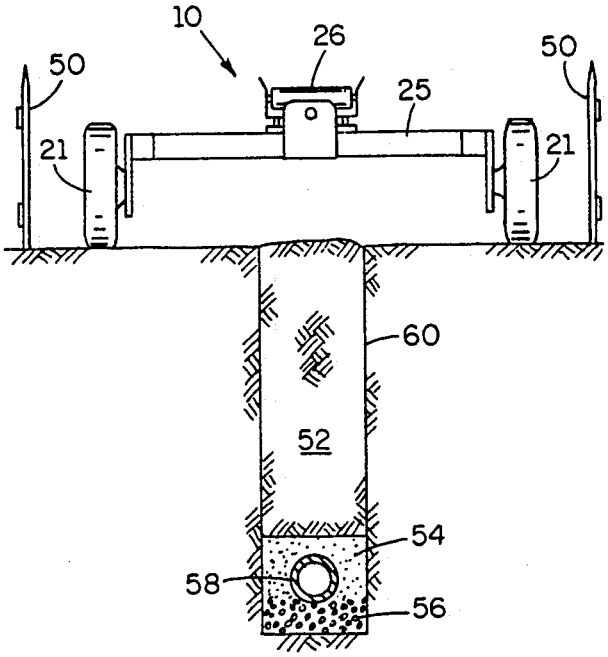
FIG. 3 is a front cross-sectional view of a part of the apparatus showing it straddling a trench and further showing a cross-section composite soil profile of an excavated trench into which water or sewage pipe has been laid.
Figure 2B:
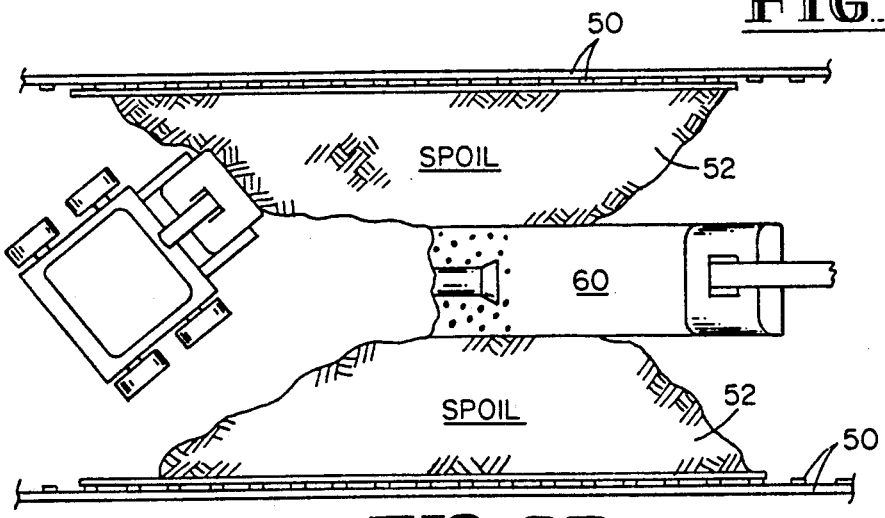
FIG. 2B (PRIOR ART)

FIGS. 2*a*, 2*b* and 3 illustrate the prior art and the environment in which apparatus (10) operates. FIG. 2*a* illustrates the method of excavating spoil (52) from trenches (60), wherein spoil (52) is placed near or against lateral restrictions such as fence (50). Further, FIGS. 2*a* and 2*b* illustrate the resultant cross section of material when trench (60) is evacuated, backfilled with spoil or ordinary backfill (52), select material (54) and bedding (56). Pipe sections (58) are laid on top of bedding (56) and covered with select material (54) before the backhoe redeposits the spoil that had been previously removed. The use of the prior art method and the present method results in a cross section of trench similar to FIG. 2*a*.

In FIG. 3, apparatus (10) is seen to straddle trench (60) after bedding (56), pipe (58), select material (54) and backfill (52) have been added thereto. Apparatus (10) is then ready to move on to excavate the next section as more particularly set forth below.

The conveyer straddles the ditch. In addition, it illustrates a cross section of an excavated ditch showing (in solid lines) the outline of the excavated dirt, the bedding placed at the bottom, the pipe, the select material which lies to either side and overlies the pipe and finally the ordinary backfill or spoil.

Figure 3A:
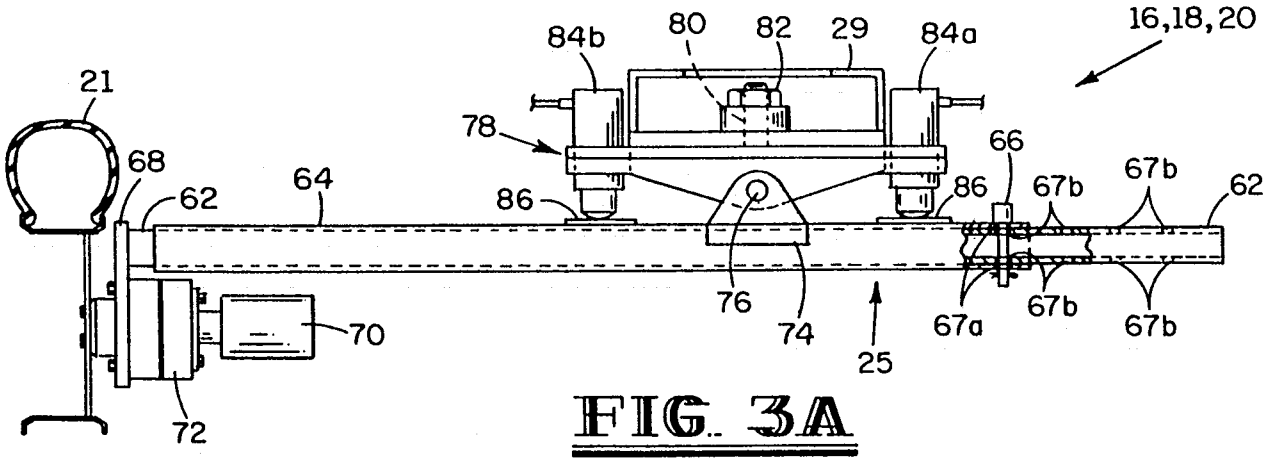
FIGS. 3*a* and 3*b* are a front elevational and a top plan view, respectively, of the axle, steering and suspension systems of the present invention.
Figure 3B:
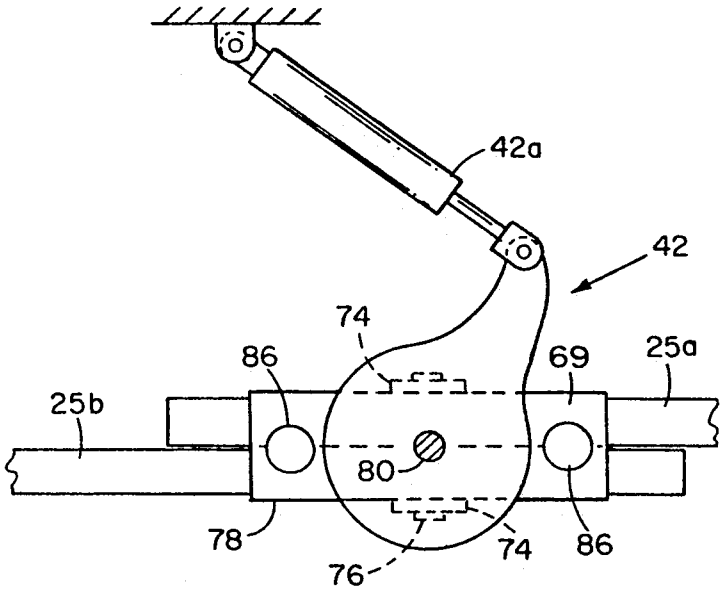

FIGS. 3*a* and 3*b* illustrate the trucks. More specifically, the trucks contain structure that allows freedom to move from a plane parallel to sections (12) and (14), to a plane nonparallel with the sections. In addition, the trucks are steerable to allow apparatus (10) to maneuver around obstacles in laterally confined spaces. Thus, trucks (16), (18), and (20) allow the operator to steer the apparatus and also allow the conveyer belts to maintain a generally level alignment while the trucks of sections (12) and (14) negotiate uneven terrain. Last, trucks (16), (18), and (20) comprise axles (25) with means capable of extensibly altering the track width between wheels (21). This allows apparatus (10) to straddle ditches of varying widths.

Thus, FIG. 3*a* illustrates trucks (16), (18), and (20) with interconnect means (29) to locate the same to subframe (30)—(on first section (12))—or to support members (40)—(on second section (14)). More particularly, trucks (16), (18), and (20) contain axle (25) which comprises inner axle (62) slidably engaged within outer axle (64). Axles (62) and (64) fit snugly, inner within outer, and are made up of square tubing (in cross section). Further, pin (66) engages hole (67*a*) in outer axle (64) and one of several hole sets (67*b*) in inner axle (62). Operator, by manually removing pin (66) and sliding inner axle (62) within outer axle (64) until holes (67*a*) and (67*b*) align, can thereby selectively set the track width between wheels (21).

As can be seen in FIG. 3*b*, axle (25) consists of a unit made up of half axles (25*a*) and (25*b*), which half axles are joined laterally one against the other on axle mounting plate (69). Thus, there is about a four-inch stagger between corresponding left and right side wheels of a given truck. This condition does not present any operational limitations given the environment in which apparatus (10) is designed to work.

Wheels (21) are mounted to inner axle (62) through mounting plate (68), and each wheel (21) is driven by hydraulic motor (70) operating through gear box (72), which is mounted on plate (68). One such hydraulic motor is Danfoss OMR 151-0238.

FIGS. 3*a* and 3*b* also illustrate the means by which axle (25) can pivot in response to negotiating uneven terrain surfaces. That is, axle mounting plate (69) contains bracket (74) fastened thereto, which bracket (74) contains pin (76), which engages tilt frame (78). Articulation at pin (76) allows axle (25) to pivot on a longitudinal axis about pin (76).

Hydraulic rams (84*a*) and (84*b*) are mounted to adjacent sides of steering pivot (80) and control deflection of axle (25) about pin (76). Right side hydraulic rams (84*a*) are all linked in series with each other as are left side hydraulic rams (84*b*). Hydraulic fluid flow among these linked rams is not restricted, thus removing torsional strains between the two sections and lessening the resultant tip from one wheel entering a low spot in the terrain. Both hydraulic rams (84*a*) and (84*b*) will lock axles under positive pressure on both sides at points (86). This hydraulic lock is maintained by blocking the flow ports. Tilt of axle (25) is accomplished by opening flow into one ram which simultaneously allows fluid to escape from the others but only fast enough to maintain a preset pressure on the energized ram, thus giving positive "tilt" control. Load-hold checks in the ram control valves allow for positive positioning of axles (25).

Tilt frame (78) will rotate in a horizontal plane with respect to interconnect means (29) at steering pivot (80). Steering pivot (80) is secured by fastening means (82). The upper surface of tilt frame (78) and the lower surface of interconnected means (29) are bearing surfaces at which steering of axles (25) occurs. Steering means (42) is more specifically illustrated in FIG. 3*b* which shows steering cylinder (42*a*) attached at a first end to tilt frame (78) and at a second end to the frame or solid structure of the apparatus. In this manner, steering cylinder (42*a*) will remain in the same plane as sections (12) and (14) and tilt frame (78) as axles (25) articulate at pin (76). Expansion and contraction of steering cylinder (42*a*) causes tilt frame (78) and thus axle (25) to rotate with respect to interconnect means (29).

Bay (36) contains a three-section hydraulic pump such as "Hydura" model TZW 34-LDFY-CNSNT, manufactured by The Oil Gear Co., Milwaukee, Wis. Bay (36) also contains an internal combustion engine such as a 70 h.p. General Motors diesel engine for powering the three-section pump. One section of the pump handles only the steering, one handles the conveyor, and one the remaining hydraulic functions. Control panel (38*a*) contains controls to a series of four-way valves such as those sold under the mark "Husco 5000," AMCA, International, Waukesha, Wis., which valves control the hydraulic system of apparatus (10).

FIGS. 4*a*–4*e* illustrate the method by which the above described apparatus operates. In general, the function of the apparatus is to receive material excavated to form a trench, to lay in bedding material, and after the pipe is laid, to lay in select material and to refill the excavated trench with spoil being excavated from the next section.

FIGS. 4*a*–4*e* describe a method which radically reduces the time and expense of accomplishing this process. FIGS. 4*a*–4*e* detail the excavation and filling of a trench using a two-section conveyor apparatus which has drive belts capable of being reversed, a means of attaching first and second section, which means can pivot in a horizontal plane and also allows one end of the adjacent ends of the conveyor unit to be raised with respect to the second. More particularly, use of the unique apparatus described herein above allows for a method of removing virgin overburden to an off-site location by depositing overburden at the first end of the first conveyor section for transportation to the second end of the second conveyor section. Moreover, burden is removed by a backhoe for depositing on the first end of the first conveyor section which overburden is dumped off the second end of the first conveyor section into a previously excavated trench; the previously excavated trench now containing the bedding and pipes. The removal of the virgin overburden plus the overburden for redepositing in an existing trench section is in an amount sufficient to excavate a section of trench equivalent to about 20 feet in length (or a distance appropriate to the length of the pipe sections being used). Then, adding bedding material by depositing it on the second end of the second unit for dropping into the trench alternately off the first end of the second unit or the first end of the first unit, allows the trench to be excavated and refilled in a novel manner which avoids the necessity of piling up overburden or spoil laterally to either side of the trench.

That is, FIGS. 4*a*–4*e*, as set forth herein, allow for a method of excavating and refilling a trench by sequentially repeating the steps as set forth below with the backhoe advancing as it digs out the trench and deposits the overburden or spoil onto the first end of the first unit, as the first unit is transported longitudinally along in the direction the trench is being excavated.

Figure 4A:
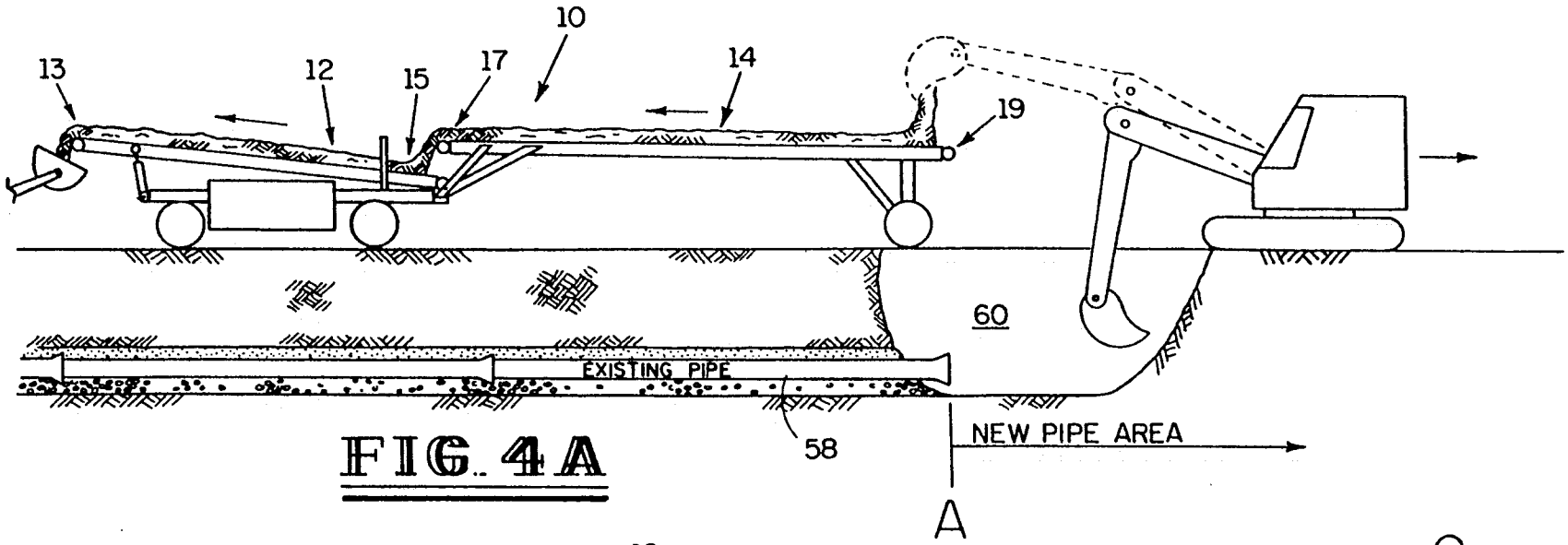
FIGS. 4*a*–4*e* illustrate the method of the present invention.

FIGS. 4*a*–4*e* illustrate the method by which the apparatus operates in conjunction with the backhoe and workers to remove spoil from the trench, lay bedding, piping, select material and backfill. More particularly FIG. 4*a* illustrates the commencement of an excavation job showing the backhoe beginning the job at a point where the existing pipe joins with the new pipe to be laid. The new pipe area is to the right of point A in FIG. 4*a*.

The backhoe operator commences excavation and moves in the direction of the arrow while depositing excavated spoil onto the first end of section 1 of the apparatus, whose belts carry the spoil from the first end of section 1 to the second end of section 1 in the direction as indicated. The adjacent ends are set so that the first end of section 2 is lower than the second end of section 1 and under the impetus of gravity, the spoil will fall from section 1 to section 2 and be carried to a loader for transportation off-site as indicated by the movement of the conveyer belt of section 2 in FIG. 4*a*. The backhoe and the apparatus move to the right as illustrated in FIG. 4*a* as new spoil is excavated. Thus, the first step when entering upon or commencing a work project is to excavated a trench area sufficient to lay down a section of pipe.

Figure 4B:
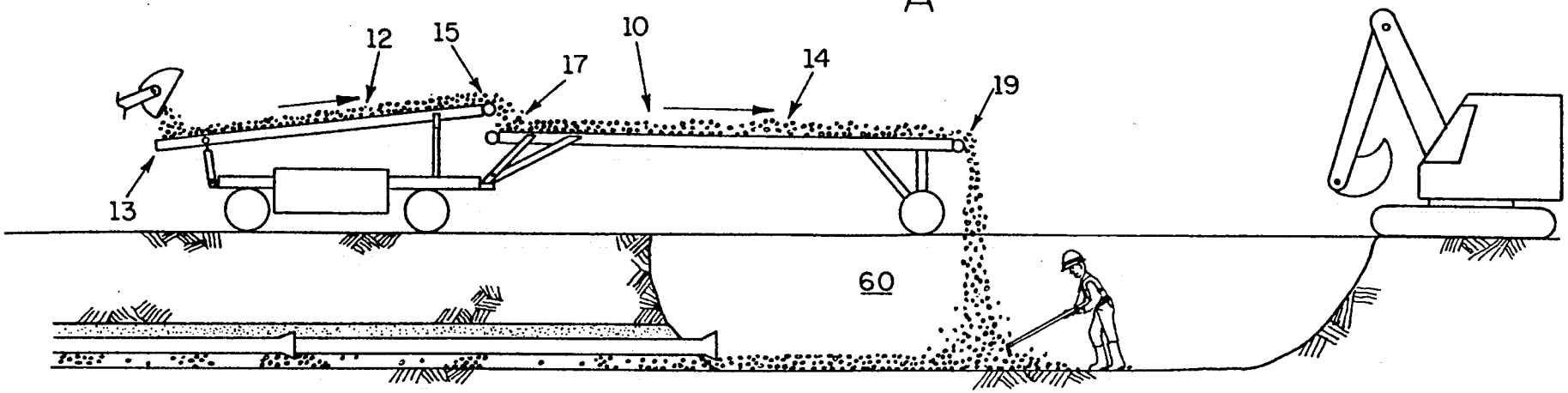

FIGS. 4*b*–4*e* illustrate a series of steps that are repeated throughout the excavation. These figures illustrate the direction of movement of the conveyer belts of section 1 and section 2, the position of the adjacent ends of the unit and the movement of material. More specifically, FIG. 4*b* illustrates the pipe/bedding preparation step wherein the backhoe is at rest. Here, the conveyer belts are operated in the directions indicated by the arrows and carry bedding material from a source off-site to the newly excavated trench. The adjacent ends of the sections are set with the first end of section 2 above the second end of section 1. When sufficient bedding material is laid the new pipe section is installed.

Figure 4C:
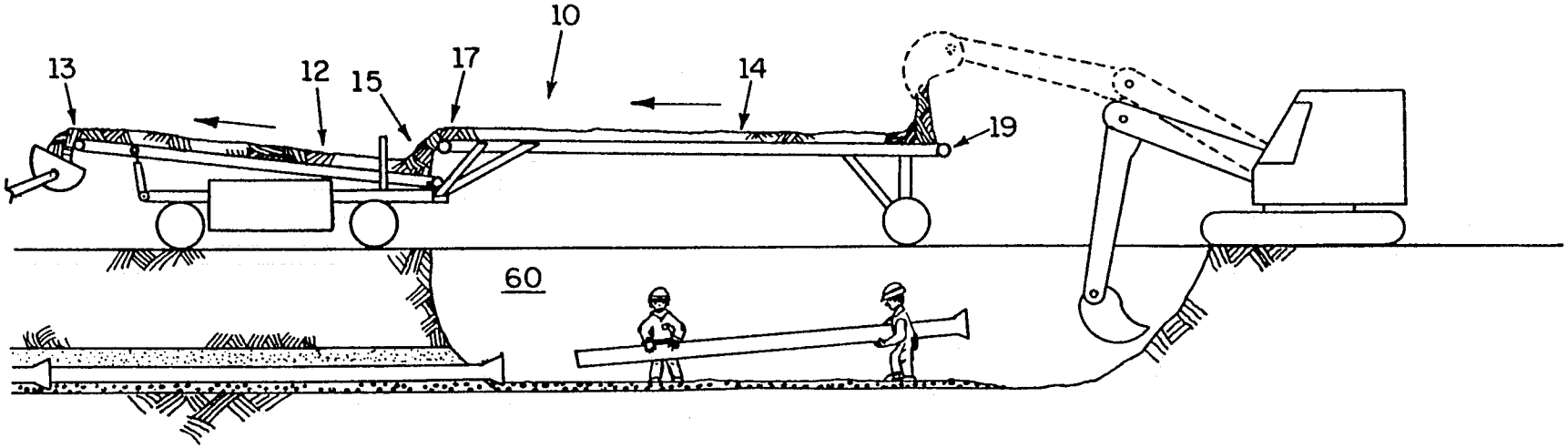

FIG. 4*c*. As the workmen install a new section of pipe, the backhoe begins the excavation of excess material from a new excavation face. That is, because spoil expands as it is removed from the ground and because fill, select material and piping is added to the bottom of the trench, each new section excavated will have a certain amount of excess spoil material that needs to be removed for proper off-site disposal. This "excess" spoil material is removed at the beginning of a new section while workmen lay the pipe in the previously excavated section. This excess spoil is removed for off-site dumping. As can be seen in FIG. 4*c*, conveyer belts of both sections operate to carry the excess material off-site and adjacent ends are positioned such that the first end of section 2 is below the second end of section 1. After the backhoe has excavated sufficient excess material from the next trench, it rests.

Figure 4D:
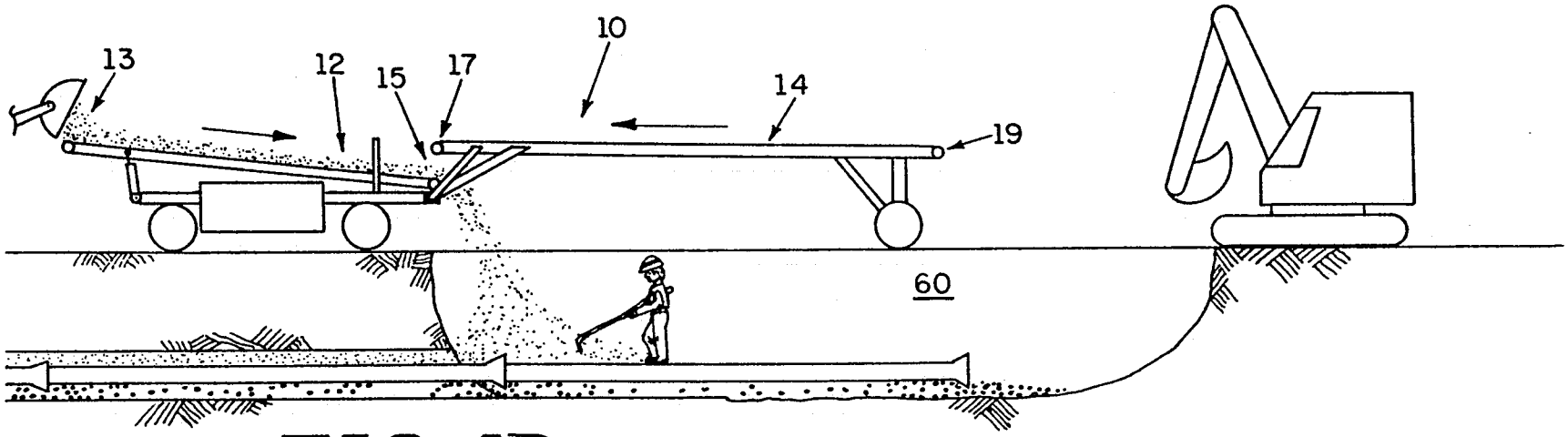

FIG. 4*d* illustrates the backhoe at rest, having removed sufficient excess material from the beginning of the next section. At this time, the apparatus is used to carry in "blinding" (sand or washed gravel) to cover the newly laid pipe with the select material. This material is brought in from off-site and the direction of conveyer belt is as illustrated in FIG. 4*d*, allowing material to be carried from off-site to the trench for deposit into the trench where sections 1 and 2 meet. Following the spreading of the select material around the top of the pipe, the trench is ready to be backfilled from material excavated from the excavation face as illustrated in FIG. 4*e*.

Figure 4E:
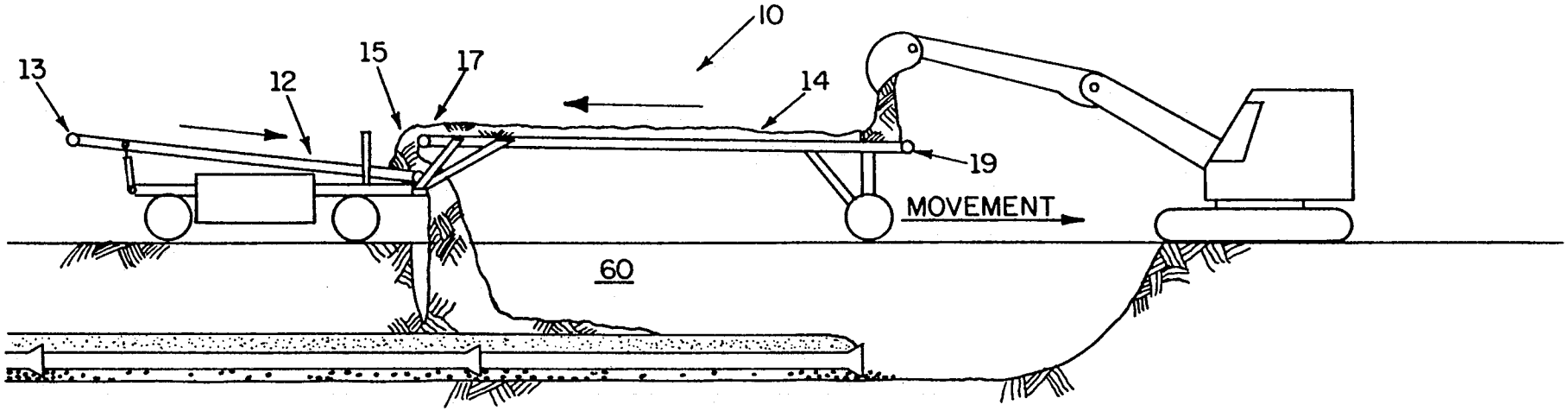

FIG. 4*e* illustrates the removal/backfill step with the backhoe operating, removing spoil from a new trench section and using it to backfill the previously excavated trench section. Both conveyer belts are operating with the belts in opposite directions as indicated in the figures and the backhoe and the apparatus move to the right as newly excavated spoil is used to backfill the previously excavated trench.

Thus, by repeating steps 4*b* through 4*e* in succession, the operator can maintain a moving trench (in left-right direction as illustrated in FIGS. 4*b* to 4*e*) with the majority of the excavated spoil being used simultaneously to backfill the previously excavated trench. Note: Claim 11 begins the sequence at 4*e*, then goes to 4*b*, 4*c*, and 4*d*.

While the preferred embodiment discloses a two-section unit, an alternate preferred embodiment would contain three or more sections, with articulation occurring where each of the sections join, and in which the adjacent ends are capable of being raised or lowered relative to sections on either end. That is, an alternate preferred embodiment of the apparatus would contain more than two conveyor belt units.

The apparatus has been described in connection with the preferred embodiments, although it is not intended to limit the invention to the particular forms set forth above; but, on the contrary, it is intended to cover such alternatives, modifications, and equivalents as may be included within the spirit and scope of the invention as defined by the appended claims.

We claim:

1. A method for aiding the excavation and filling of trenches in laterally confined spaces using an apparatus comprising;

a first longitudinal conveyer section and a second longitudinal conveyer section, each of said sections having a first end and a second end;

a first and a second endless conveyer belt located on said first and second conveyer section;

belt drive means for energizing said conveyor belts, said belt drive means capable of reversing direction;

link means for attaching the second end of said first section with the first end of said section second section, said link means further comprising pivot means for selectively allowing a straight or angled relationship between the longitudinal axis of said sections;

means for selectively positioning the linked ends of said sections, one above the other; and truck means for steerably supporting said first and said second conveyer sections, said truck means having wheels and spaced sufficiently wide to straddle the trench:

the method comprising:

(a) removing virgin overburden for dumping at an off-site location by depositing overburden on the first end of the first conveyor unit for transportation to the second end of the second conveyor unit;

(b) removing overburden for depositing on the first end of the first conveyor unit which overburden will be dropped off the second end of the first conveyor unit into previously excavated trench which contains bedding and pipe, wherein steps (a) and (b) remove sufficient overburden to lay a section of pipe;

(c) adding bedding material by depositing it on the second end of the second unit for dropping into the trench ultimately off the first end of the second unit and the first end of the first unit until sufficient bedding has been laid;

(d) laying a section of pipe;

(e) adding overburden from step (b) above in an amount sufficient to refill the trench;

wherein steps (a) through (e) are completed sequentially as the apparatus moves longitudinally in the direction of excavation until such a time as the excavation is complete.

2. A method for excavating and refilling trenches in laterally confined regions using a trench-straddling conveyor apparatus, said apparatus comprising a first longitudinal section with a free end and an adjacent end, and a second longitudinal section with a free end and an adjacent end, both of said sections having a reversible conveyor belt thereon, said longitudinal sections being linked together with articulable link means at adjacent ends thereof, said conveyor apparatus further comprising a means for selectively locating one of said adjacent ends above the other, said method comprising the steps of:

longitudinally transporting excavated material from the free end of the first longitudinal section across both of the longitudinal sections of the conveyor apparatus to the free end of the second longitudinal section for disposal off-site;

longitudinally transporting bedding and select material from the free end of the second longitudinal section to the adjacent ends of the first and the second longitudinal sections for depositing into previously excavated trench; and longitudinally transporting excavated material across the first longitudinal section of the apparatus for depositing at the adjacent ends of the first and the second longitudinal sections the excavated material into the trench containing pipe therein;

wherein said apparatus is moved longitudinally as the repetition of said steps set forth above excavates the trench at a first end thereof and refills the trench at a second end thereof.

3. A method to aid in the excavation and filling of a trench using a conveyor apparatus with reversible belt drives, a first section and a second section, said first and said second sections each having a first end and a second end, link means for attaching the second end of said first section with the first end of said second section, said links means further comprising pivot means for selectively allowing a straight or angled relationship between the longitudinal axis of said sections, a first conveyor section and a second conveyor section, the method comprising the steps of:

(a) depositing spoil on the first end of the first section;

(b) carrying the spoil from the first end of the first section to the second end of the first section;

(c) dropping the spoil onto the first end of the second section;

(d) dropping the spoil off the first end of the second section into the excavation in an amount sufficient to cover bedding, pipe section, and fill the trench, the unit advancing as trench is backfilled;

(e) raising the first end of the second section relative to the second end of the first section to a position above the second end of the first section;

(f) reversing the belt of the first section;

(g) loading bedding material on the second end of the second section;

(h) carrying the bedding material from the second end of the second section to the first end of the second section;

(i) dropping the bedding material from the first end of the second section onto the second end of the first section;

(j) carrying the bedding material from the second end of the first section to the first end of the first section;

(k) dropping bedding material into the excavation;

(l) grading the bedding material;

(m) lowering the first end of the second section relative to the second end of the first section such that the first end of the second section is lower than the second end of the first section;

(n) reversing both belts;

(o) depositing spoil from an excavation face on a first end of the first section;

(p) carrying spoil from the first end of the first section to the second end of the first section;

(q) dropping spoil off the second end of the first section onto the first end of the second section, the first end of the second section being lower than the second end of the first section;

(r) carrying spoil from the first end of the second section to the second end of the second section;

(s) dropping excess into removal means for transportation off-site;

(t) laying and connecting pipe during time interval covered by steps (O)-(S);

(u) reversing the belt of the second section;

(v) loading select material on the second end of the second section;

(w) carrying the select material from the second end of the second section to the first end of the second section;

(x) dropping the bedding material off the first end of the second section into the excavation;

(y) spreading select material to cover pipe and (z) repeating said sequence of steps (a) through (y) above until excavation and fill are complete.

* * * * *